United States Patent [19]

Gurevich

[11] Patent Number: 4,928,384

[45] Date of Patent: May 29, 1990

[54] METHOD OF MAKING A WIRE BONDED MICROFUSE

[75] Inventor: Leon Gurevich, St. Louis, Mo.

[73] Assignee: Cooper Industries, Inc., Houston, Tex.

[21] Appl. No.: 417,930

[22] Filed: Oct. 6, 1989

Related U.S. Application Data

[60] Continuation of Ser. No. 148,263, Jan. 28, 1988, abandoned, which is a division of Ser. No. 29,831, Mar. 24, 1987, Pat. No. 4,771,260.

[51] Int. Cl.[5] ..... H01H 69/02

[52] U.S. Cl. ..... 29/623; 228/110; 228/179

[58] Field of Search ..... 29/623; 228/110, 179; 337/255, 231, 232, 208, 273; 361/104

[56] References Cited

U.S. PATENT DOCUMENTS

| | | | |
|---|---|---|---|
| 3,374,330 | 3/1968 | Cameron | 337/231 |
| 4,337,570 | 7/1982 | Woznica | 29/623 |
| 4,437,604 | 3/1984 | Razon et al. | 228/179 |
| 4,534,811 | 8/1985 | Ainslie et al. | 228/110 |
| 4,580,713 | 4/1986 | Sekibaya et al. | 228/110 |
| 4,680,568 | 7/1987 | Corrao et al. | 337/186 |
| 4,751,489 | 6/1988 | Spaunhorst | 337/260 |
| 4,773,157 | 9/1988 | Galloway et al. | 29/623 |

FOREIGN PATENT DOCUMENTS

| | | | |
|---|---|---|---|
| 1135871 | 11/1982 | Canada . | |
| 3304263 | 8/1984 | Fed. Rep. of Germany | 29/623 |

*Primary Examiner*—P. W. Echols

*Attorney, Agent, or Firm*—Donald J. Verplancken; David A. Rose

[57] ABSTRACT

A microfuse (10) with a ceramic chip (12), thick film pads (14), fusible wire (16), attached to pads (14) without solder or flux, ceramic coating (18) and plastic body (20). External lead (24) configuration can be axial, radial or surface mount. The method of manufacturing the fuse (10) is improved by utilizing a wire bonding technique in order to improve the quality of the manufacturing process and increase the reliability in performance of the fuse and reduce manufacturing cost.

38 Claims, 4 Drawing Sheets

METHOD OF MAKING A WIRE BONDED MICROFUSE

This is a continuation of co-pending U.S. Patent Application Ser. No. 07/148,263, filed Jan. 25, 1988, now abandoned which is a divisional application of U.S. Patent Application Ser. No. 07/029,831 filed Mar. 24, 1987, now U.S. Pat. No. 4,771,260.

BACKGROUND OF THE INVENTION

This application pertains to fuses in general and more particularly to a microfuse and method of making microfuses using ultrasonic bonding.

Microfuses are used primarily in printed circuits and are required to be physically small. It is frequently necessary to provide uses designed to interrupt surge currents in a very short period of time. For example, to limit potentially damaging surges in semiconductor devices, it is often necessary to interrupt 125 volt short circuit currents up to 50 amps AC or 300 amps DC in a time period of less than 0.001 seconds, in order to limit the energy delivered to the components in series with the fuse. Current art has interruption durations of approximately 0.008 seconds and $i^2t$ values that could damage semiconductor devices.

Previous attempts to provide fuses operating in this range have utilized thin wires in air with a diameter of approximately 0.0005" to 0.015". The use of small diameter wire for fuse elements has a number of problems related to present manufacturing technology.

One problem is that it is difficult to manufacture a low-cost microfuse. The reason for this is that the fusible element has such a small diameter, measured in thousandths of an inch, that manual methods of attaching the fusible element to the lead wires or end caps is required.

Several problems are caused by use of solder and flux to attach the fusible wire element. In such a small device, it is difficult to prevent the solder used to attach the wire ends from migrating down the wire during the manufacturing process. This causes a change in the fuse rating In addition, the fuse rating may be changed when the external leads are soldered onto a printed circuit board. Wave soldering, vapor phase soldering and other processes are typically used to solder parts to PC boards. The heat generated in these processes can melt and reflow the solder inside the fuse. Consequently, the fuse rating can be changed in the act of attaching the fuse to the PC board. It is also possible to lose contact to the fusible wire element entirely when the inner solder melts, rendering the fuse useless.

Another problem caused by the use of solder and flux inside the fuse body is that the solder and flux may be vaporized by the arc during a short circuit and can interfere with the arc interruption process.

An additional problem with present manufacturing processes is that it is difficult to accurately control the length of the wire element and to position it properly in the enclosing fuse body. Consequently, when hot, the wire element may contact the wall of the fuse body. This will also change the fuse rating and prevent the fuse from opening on low overloads.

Yet another problem with prior art design of microfuses is that the fusible element is not encapsulated in an arc quenching medium. The $i^2t$ value for short circuit interruptions of wire elements in air is much greater as a consequence of the longer time required to achieve circuit interruption.

SUMMARY OF THE INVENTION

A microfuse according to the present invention is manufactured by printing thick film pads onto a ceramic plate. The ceramic plate or substrate is subdivided into chips to which lead wires are attached by resistance welding and fusible elements are attached by ultrasonic bonding. The fuse assembly, comprised of chip, pads or metallized areas, lead wires and fusible element is then coated with ceramic insulating material and surrounded by an injection molded plastic body. Use of these techniques improves the consistency of performance of the fuse and enables automation of the manufacturing process.

The placement of the wire fuse element, the wire length, and the height of the wire above the chip can all be computer controlled when the wire bonding process is utilized. The separation of the metallized pads is also accurately controlled. These aspects in combination with a design which does not utilize solder or flux in the fabrication process yields a fuse design characterized by consistency of performance The addition of the arc quenching coating yields a fuse design that significantly reduces let-through $i^2t$.

DETAILED DESCRIPTION OF THE DRAWINGS

Figure 1:
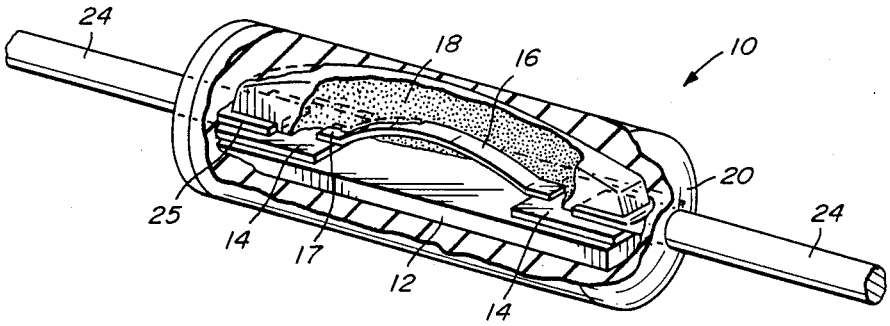
FIG. 1 is a perspective view, partially cut away, of an axial microfuse according to the present invention.

FIG. 1 shows an axial microfuse 10, partially cut away, according to the present invention. Substrate or chip 12 is of an insulating material and has two thick film pads or metallized areas 14 at either end. Lead wires 24 are attached to the outside edges of thick film pads 14 and a fusible wire element 16 is connected to the inner edges of pads 14. Ceramic coating material 18 encapsulates fusible element 16, pads 14 and the ends of lead wire 24. The ceramic coated fuse is encapsulated in a molded plastic body 20.

Figure 2:
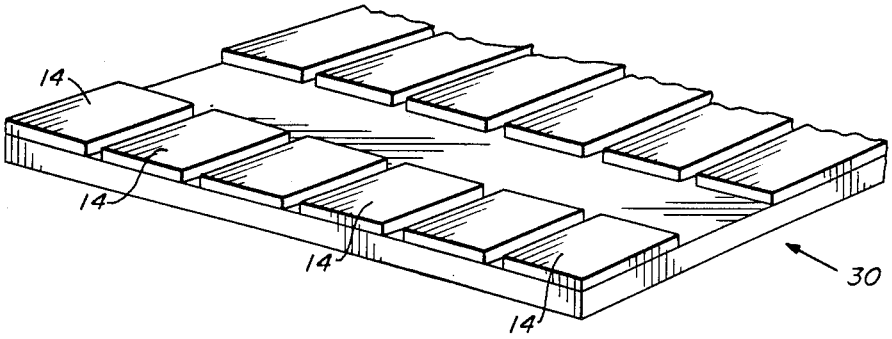
FIG. 2 is a perspective view of a segment of an insulating plate used in the making of microfuse substrates.

The first step in manufacturing a fuse according to the present invention begins with providing a plate of insulating material such as is shown in FIG. 2. Ceramic is the material of choice in the present invention. During arc interruption, temperatures near the arc channel can exceed 1000° C. Therefore, it is necessary that the insulating plate material can withstand temperatures of this magnitude or higher. It is also important that the material not carbonize at high temperatures since this would support electrical conduction. Suitable plate materials would include glasses such as borosilicate glass and ceramics such as alumina, berrillia, magnesia, zirconia and forsterite.

Another important property of plate 30 is that it have good dielectric strength so that no conduction occurs through plate 30 during fuse interruption. Once again, the ceramic polycrystalline materials discussed above have good dielectric strength in addition to their thermal insulating qualities.

Step 2 is to print Plate 30 using a screen printing process or similar process such as is well known in the industry. In this process, a screen having openings corresponding to the desired pattern is laid over plate 30. Ink is forced through the openings onto the plate to provide a pattern of metallized areas or pads 14 which will later serve for attachment of lead wires and fusible elements. The ink that is used to form pads 14 is a silver based composition or other suitable compositions that possess the right combination of conductivity and ductility required for wire bonding. In the preferred embodiment, a silver, thick film ink is used such as Cermaloy 8710, available from Heraus Company, 466 Central Avenue, Northfield, Ill. An alternative ink is ESL 9912, available from Electro Science Lab, 431 Lansdale Drive, Rockford, Ill. Other suitable materials for the metallized areas are copper, nickel, gold, palladium, platinum and combinations thereof.

Pads 14 may be placed on plate 30 by other methods than printing. For example, metallized pads may be attached to plate 30 by a lamination process. Another alternative would be to provide pads on plate 30 by vaporized deposition through techniques using sputtering, thermal evaporation or electron beam evaporation. Such techniques are well known in the art.

After the pattern of metallized ink rectangles or pads are printed on plate 30, the plate is dried (Step 3) and fired (Step 4). A typical drying and firing process would be to pass plate 30 through a drying oven on a conveyor belt where drying takes place at approximately 150° C. and firing takes place at approximately 850° C. The drying process drives off organics and the firing process sinters and adheres the pads to plate 30.

The pads laid down on plate 30 by the printing process are approximately 0.0005" thick. Pads of various thicknesses may be used depending on various factors such as conductivity of the metallized pad and width and length of the pad.

Figure 3:
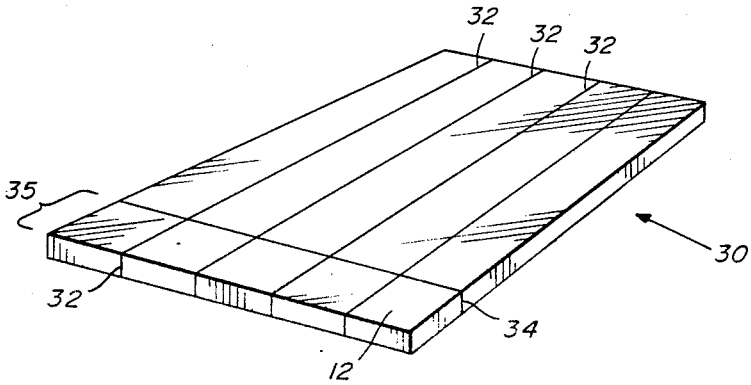
FIG. 3 is a perspective view of a plate used in the making of microfuse substrates which has been scored.
Figure 4:
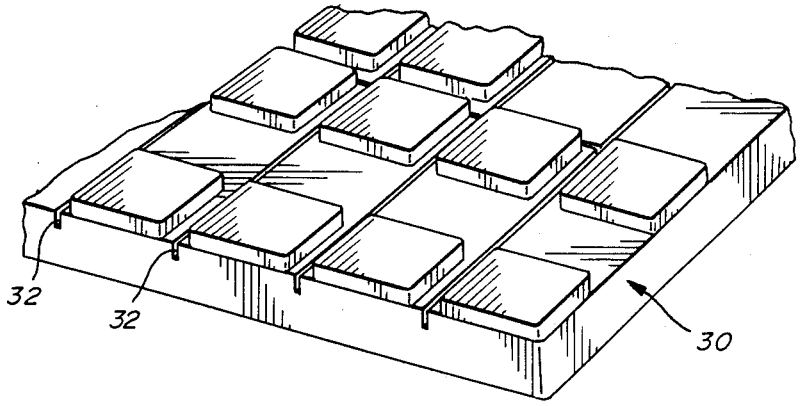
FIG. 4 is a perspective view of an enlarged portion of the detail shown in FIG. 3 after printing and scoring

Plate 30 in the preferred embodiment is about 2½" square and approximately 0.015" to 0.025" thick. The plate is subdivided (Step 5) into chips or substrates by scoring longitudinally 32 and horizontally 34 as shown in FIGS. 3 and 4. The number of resulting chips will vary according to chip size. Score marks may be made by any suitable means known in the art such as scribing with a diamond stylus; dicing with a diamond impregnated blade, or other suitable abrasive; scribing with a laser; or cutting with a high pressure water jet. The scribe marks should not completely penetrate plate 30, but only establish a fault line so that plate 30 may be broken into rows 35 and later into individual chips 12 by snapping apart or breaking. In the preferred embodiment, dicing with a diamond impregnated blade is used.

In an alternate embodiment, the plate is fabricated with score lines preformed. In the case of a ceramic substrate, the ceramic is formed in the green state with intersecting grooves on the surface and then fired. Step 5 would be omitted in this embodiment.

Figure 6:
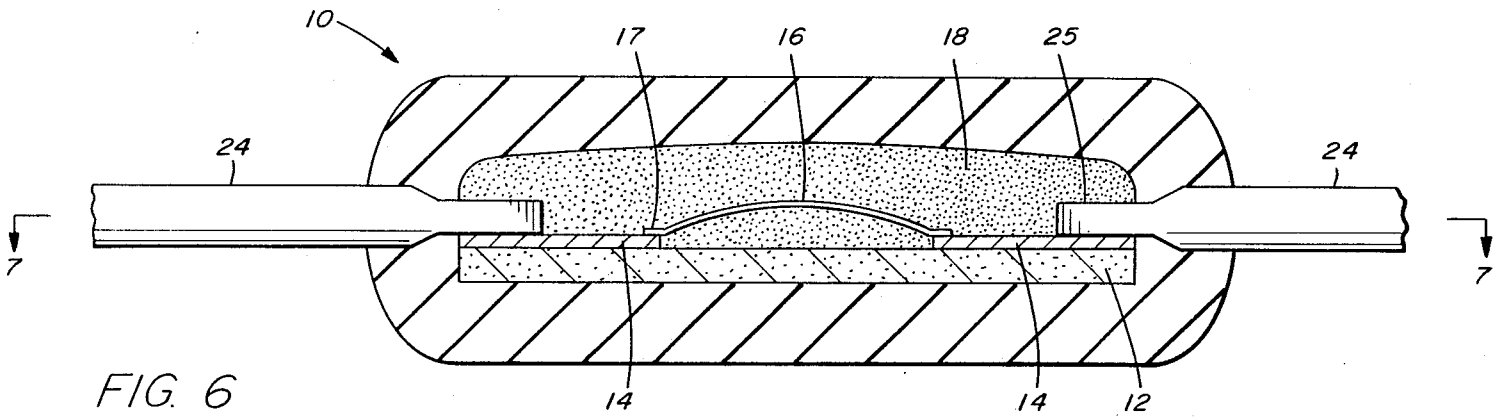
FIG. 6 is a cross-sectional view from the side of an axial microfuse according to the present invention.
Figure 7:
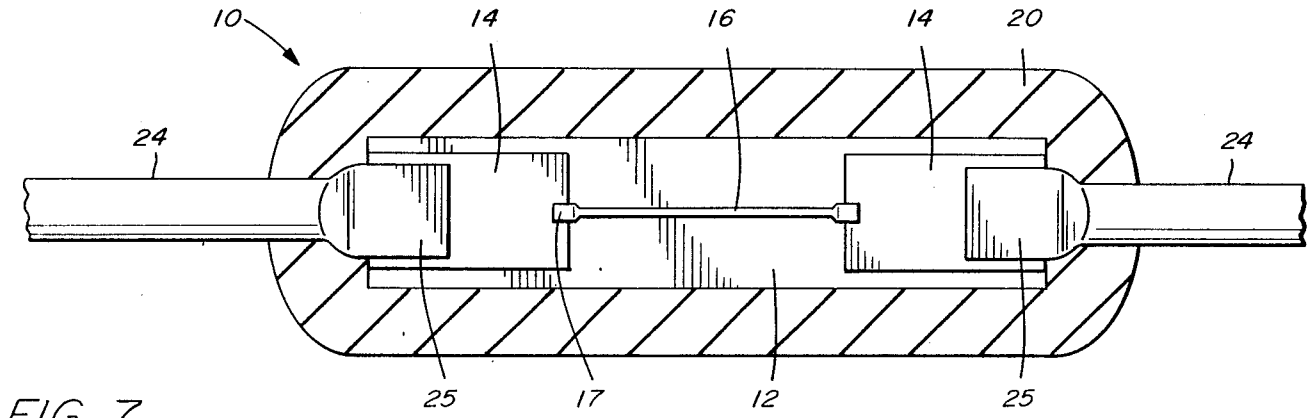
FIG. 7 is a cross-sectional view from the top of an axial microfuse according to the present invention.

A fusible element 16, shown in more detail in FIGS. 6 and 7, is attached by ultrasonic bonding (Step 6). Several ultrasonic bonders are available commercially that may be utilized for attaching fusible element 16. One bonder called a Wedge Bonder is available from Kulicke Soffa Industries, Inc., 104 Witmer Road, Horsham, Pa. 19044. In this type of automatic bonding machine, a bonding tool called a wedge, with an orifice for wire feeding, is pressed down onto a surface such as pad 14. As can be seen in FIG. 7, the wedge tool flattens one end 17 of fusible element 16. The flattened end 17 is pressed into pad 14, which is somewhat ductile, as ultrasonic energy causes physical bonding of wire end 17 and pad 14. The wedge tool then dispenses a length of fusible wire 16 and repeats the flattening and bonding process on the other pad 14.

Other methods of ultrasonic bonding are also acceptable. For example, a bonder from the same manufacturer called a Ball Bonder melts the end of fusible wire 16, forming a ball shape, forces it down into pad 14, dispenses the proper length of fusible element wire 16 and forms a wedge bond on the opposite end of ceramic substrate 12. Other methods of bonding which do not employ flux and solder are also feasible such as, for example, laser welding, thermosonic bonding, thermo compression bonding or resistance welding.

In the preferred embodiment, aluminum or gold wire is used for the fusible element. Copper wire can also be used, but currently available wire bonders are restricted to the ball bonding technique. Silver wire can also be bonded using non-automated equipment. Other wire materials such as nickel may be utilized in the future as suitable ultrasonic bonding equipment is developed. The fusible element may be in the form of a wire or in the form of a metal ribbon.

Figure 5:
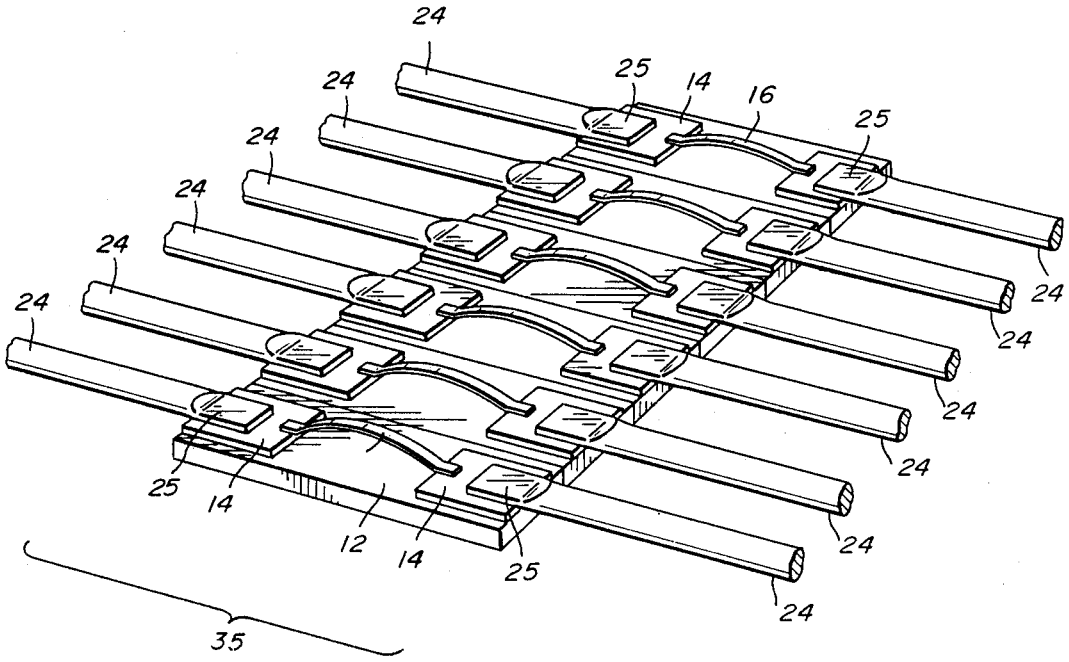
FIG. 5 is a perspective view of a row of microfuse substrates with lead wire attached.

A row 35 of chips is snapped off as is shown in FIG. 5 (Step 7). This row of chips then has lead wires attached at each end of chip 12 by resistance welding (Step 8). Resistance welding is a process where current is forced through the lead wire 24 to heat the wire such that bonding of the lead wire to pad 14 is accomplished. Parallel gap resistance welders of this type are well known in the art and are available from corporations such as Hughes Aircraft which is a subsidiary of General Motors. Lead wires 24 have a flattened section 25 which provides a larger area of contact between lead wire 24 and pads 14. The end of lead wire 24 may be formed with an offset in order to properly center substrates or fuse elements in the fuse body.

Each individual fuse assembly, comprising chip 12, pads 14, fusible element 16 and lead wires 24, is broken off (Step 9) from row 35 one at a time and coated or covered (Step 10) with an arc quenching material or insulating material, such as ceramic adhesive 18. Step 10 may be performed by dipping, spraying, dispensing, etc. Other suitable coatings include, but are not limited to, other high temperature ceramic coatings or glass. This insulating coating absorbs the plasma created by circuit interruption and decreases the temperature thereof. Ceramic coatings limit the channel created by the vaporization of the fusible conductor to a small volume. This volume, since it is small, is subject to high pressure. This pressure will improve fuse performance by decreasing the time necessary to quench the arc. The ceramic coating also improves performance by increasing arc resistance through arc cooling.

In the preferred embodiment, the fuse assembly is coated on one side and the coating material completely covers the fusible element 16, pads 14, one side of chip 12, and the attached ends of leads 24. However, the invention may be practiced by covering a portion of the fuse assembly with ceramic adhesive 18. Covering a portion of the fuse assembly is intended to include coating a small percent of the surface area of one or more of the individual components, up to and including one hundred percent of the surface area. For example, the fusible element 16 may be coated, but not the pads 14 or leads 24.

The coated fuse assembly is next inserted into a mold and covered with plastic (Step 11), epoxy or other suitable material in an injection molding process. Plastic body 20 may be made from several molding materials such as Ryton R-10 available from Phillips Chemical Company.

Figure 8:
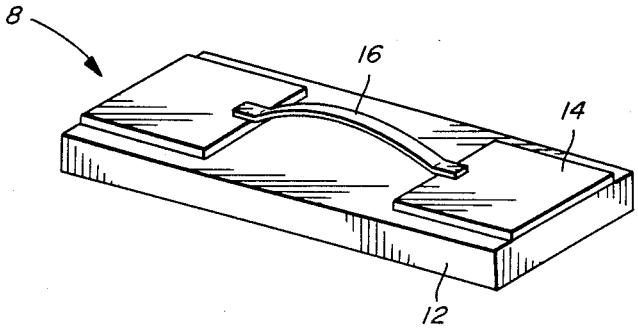
FIG. 8 is a perspective view of a fuse element subassembly according to the present invention.

In yet another embodiment shown in FIG. 8, the invention is embodied in a fuse element subassembly 8 comprised of a substrate 12, fusible element 16, and metallized pads 14. Fusible element 16 is attached to metallized pads 14 without the use of flux or solder such as by wire bonding or other methods as described above. In this simplified package, fuse subassembly 8 may be incorporated directly into a variety of products by other manufacturers when constructing circuit boards. Attachment of leads may then be in a manner deemed most appropriate by the subsequent manufacturer and encapsulated with the entire circuit board, with or without a ceramic coating as needed.

Fuse element subassemblies 8 may, be connected in parallel or in series to achieve desired performance characteristics.

Figure 9:
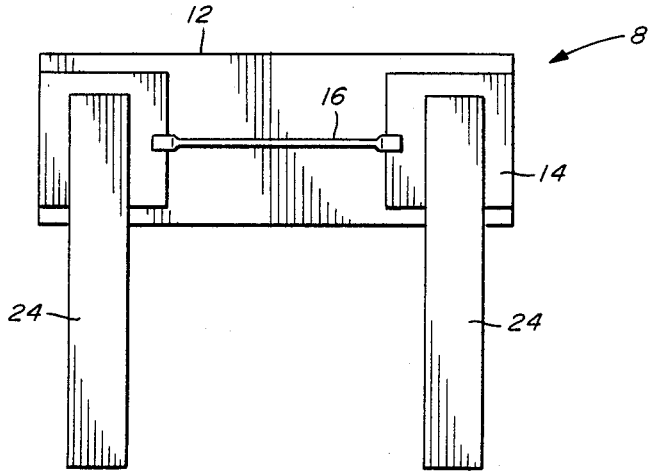
FIG. 9 is a plan view from the top of a fuse element subassembly with leads attached in a radial direction.
Figure 10:
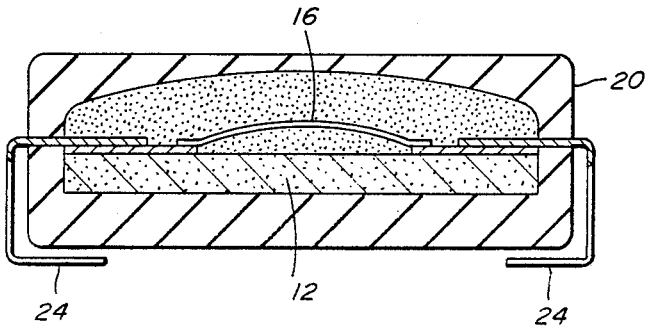
FIG. 10 is a cross sectional view of the fuse according to the present invention with leads attached in a manner suitable for surface mounting.

FIGS. 9 and 10 show alternate methods for attaching leads 24 to a subassembly 8. In FIG. 9, the leads are attached in a configuration known as a radial fuse and in FIG. 10 the leads are attached in a manner suitable for use as a surface mount fuse.

The manufacturing steps described for the axial embodiment of this invention are basically the same for the radial and surface mount embodiments with some steps performed in different sequence. The lead shape and orientation, and the plastic body shape and size can be varied to meet different package requirements without affecting the basic manufacturing requirements or performance and cost advantages of the invention.

I claim:

1. A method of making a fuse element subassembly comprising the steps of:

providing a substrate of insulating material;

producing two separate metallized areas on the substrate;

bonding one end of a fusible element to one of the separate metallized areas without using solder or flux;

extending the fusible element across the substrate to the other of the separate metallized areas;

bonding the other end of the fusible element to the other separate metallized area to electrically connect the metallized areas on the substrate; and attaching a lead to each one of the separate metallized areas without causing the lead to contact the fusible element.

2. A method of making a fuse element subassembly as in claim 1 wherein said substrate is ceramic.

3. A method of making a fuse element subassembly as in claim 1 wherein said substrate is glass.

4. A method of making a fuse element subassembly as in claim 1 wherein said substrate is alumina.

5. A method of making a fuse element subassembly as in claim 1 wherein said substrate is forsterite.

6. A method of making a fuse element subassembly as in claim 1 wherein said substrate is separated from a larger piece of insulating material by breaking along scribe lines.

7. A method of making a fuse element subassembly as in claim 1 wherein said substrate is separated from a larger piece of insulating material by breaking along lines cut part way through the larger piece.

8. A method of making a fuse element subassembly as in claim 7 wherein said cutting is by dicing.

9. A method of making a fuse element subassembly as in claim 7 wherein said cutting is by water jet.

10. A method of making a fuse element subassembly as in claim 7 wherein said cutting is by laser.

11. A method of making a fuse element subassembly as in claim 1 wherein said substrate is separated from a larger piece of insulating material by breaking along score lines preformed in the insulating material during the making of said material.

12. A method of making a fuse element subassembly as in claim 1 wherein said metallized areas are printed onto said substrate using thick film metal ink.

13. A method of making a fuse element subassembly as in claim 12 wherein said metallized areas are printed with a metal ink selected from a group of metal inks comprised of copper, gold, silver, nickel, palladium, platinum and combinations thereof.

14. A method of making a fuse element subassembly as in claim 1 wherein said metallized area is provided on said substrate by metal vapor deposition.

15. A method of making a fuse element subassembly as in claim 1 wherein said metallized area is provided on said substrate by thermal evaporation in vacuum.

16. A method of making a fuse element subassembly as in claim 1 wherein said metallized area is provided on said substrate by electron beam vaporization in vacuum.

17. A method of making a fuse element subassembly as in claim 1 wherein said metallized area is provided on said substrate by sputtering.

18. A method of making a fuse element subassembly as in claim 1 wherein said metallized area is provided by selective etching of a larger metallized region.

19. A method of making a fuse element subassembly as in claim 1 wherein said metallized area is provided by laminating metal pads to said substrate.

20. A method of making a fuse element subassembly as in claim 1 wherein said bonding is accomplished by ultrasonic bonding.

21. A method of making a fuse element subassembly as in claim 1 wherein said bonding is accomplished by laser welding.

22. A method of making a fuse element subassembly as in claim 1 wherein said bonding is accomplished by thermosonic bonding.

23. A method of making a fuse element subassembly as in claim 1 wherein said bonding is accomplished by thermocompression bonding.

24. A method of making a fuse element subassembly as in claim 1 wherein said bonding is accomplished by resistance welding.

25. A method of making a fuse comprising the steps of:

providing a substrate of insulating material;
producing two separate metallized areas on the substrate;
bonding one end of a fusible element to one of the separate metallized areas without using solder of flux;
extending the fusible element across the substrate to the other of the separate metallized areas;
bonding the other end of the fusible element to the other separate metallized area to electrically connect the metallized areas on the substrate;
attaching one lead to each of the metallized areas;
coating the substrate with an insulating material; and
injection molding the substrate, bonded fusible element, and leads in an insulating housing.

26. A method of making a fuse as in claim 25 wherein said insulating housing is plastic.

27. A method of making a fuse as in claim 25 wherein at least a portion of said substrate, metallized areas, and fusible element are covered with arc quenching material prior to injection molding the insulating housing.

28. A method of making a fuse as in claim 27 wherein said arc quenching material is ceramic.

29. A method of making a fuse comprising the steps of:
providing a substrate of insulating material;
producing two separate metallized areas on the substrate;
bonding one end of a fusible element to one of the separate metallized areas without using solder or flux;
extending the fusible element across the substrate to the other of the separate metallized areas;
bonding the other end of the fusible element to the other separate metallized area to electrically connect the metallized areas on the substrate;
attaching one lead to each of the metallized areas; and
applying an arc quenching material only to that portion of the substrate having the metallized areas and fusible element.

30. A method of making a fuse as in claim 29 wherein said arc quenching material is ceramic.

31. A method of making a fuse as in claim 29 wherein said substrate, metallized areas, fusible element, and attached ends of said leads are enclosed in an insulating housing.

32. A method of making a fuse as in claim 31 wherein said insulating housing is plastic.

33. A method of making a fuse as in claim 31 or 25 wherein said insulating housing is a molded ceramic.

34. A method of making a fuse element subassembly as in claim 1 wherein said fusible element is selected from a group consisting of aluminum, gold, silver or copper.

35. A method of making a fuse element subassembly as in claim 1 wherein said fusible element is a wire.

36. A method of making a fuse element subassembly as in claim 1 wherein said fusible element is a metal ribbon.

37. A method of making a fuse as in claim 25 or 29 wherein said lead is flattened on the end attached to said metallized area.

38. A method of making a fuse as in claim 25 or 29 wherein said lead end is offset to center the substrate in said insulated housing.

* * * * *